United States Patent [19]

Bond

[11] 4,300,475

[45] Nov. 17, 1981

[54] TONING SYSTEM

[75] Inventor: Joseph N. Bond, Commack, N.Y.

[73] Assignee: Litton Systems, Inc., Melville, N.Y.

[21] Appl. No.: 160,775

[22] Filed: Jun. 18, 1980

[51] Int. Cl.[3] ..... G03G 15/09

[52] U.S. Cl. ..... 118/657; 355/3 DD

[58] Field of Search ..... 355/3 DD, 16, 14 D; 118/657, 658, 623, 656; 430/122

[56] References Cited

U.S. PATENT DOCUMENTS 3,942,474 3/1976 Smith et al. ..... 118/657

OTHER PUBLICATIONS

*IBM TECH DISC. BULL.,* "Developer Anti-Dusting Curtain", vol. 20, No. 1, Jun. 1977, pp. 27, 28.

*Primary Examiner*—R. L. Moses

*Attorney, Agent, or Firm*—Robert F. Rotella; Michael H. Wallach

[57] ABSTRACT

A toner container is shown which includes a toner brush that moves toner to a rectangular opening partially closed by flexible triangular masks for restricting the flow of toner into contact with a sheet of paper to cause the toner to diverge as it flows across the paper thus preventing the toner from passing under the edge of the paper. The toner brush is rotatably mounted in the rectangular opening within a nonmagnetic cylinder which may be intermittently rotated. A scraper mounts against the nonmagnetic cylinder for removing accumulated toner therefrom during the intermittent rotation. As the toner moves around the cylindrical shell, under the urging of the toner brush, it is passed through a portion of the container that is laterally constricted to urge the toner into a narrow configuration in preparation for presentation to the masked opening.

14 Claims, 4 Drawing Figures

TONING SYSTEM

FIELD OF THE INVENTION

The present invention relates to an improved toning system and, more particularly, to an improved toning system which may be utilized within an electrophotographic recorder for toning a sheet of paper without depositing toner upon the back of the paper.

BACKGROUND OF THE INVENTION

In the electrophotographic art, it is well known to record utilizing either zinc oxide paper or plain paper. When zinc oxide paper is utilized, the paper is first exposed to a charge and then discharged by exposing the charged paper surface to electromagnetic radiation which may be infrared, visible or ultraviolet radiation. The charged areas of the paper surface are then exposed to a toner, which could be a liquid or a dry ink, that adheres to the charged areas. The toner is then fused to the paper by heat.

When a plain paper copier is used, a transfer element such as a selenium-coated drum, provides the surface upon which the image is placed. This surface is then exposed to toner which is later transferred to the surface of a piece of plain paper. Such printers are often referred to as xerographic printers. The selenium drum may be eliminated by utilizing a paper which has been coated with a material that will accept a charge, such as a zinc-oxide-coating. Generally, a selenium drum is used when space is not a factor but economy is as copying may be then performed upon any type of paper. A zinc-oxide recorder is utilized where space and weight are at a premium while the cost of the individual copy may not be a governing factor.

The improved toner system described in the present invention is an improvement over the toner system described in a copending patent application by Erwin Rodger entitled "TONER MECHANISM FOR ELECTROPHOTOGRAPHIC RECORDER" filed June 18, 1980 as Ser. No. 160,773 and assigned to the same assignee as the present invention.

SUMMARY OF THE INVENTION

An electrophotographic recorder requires a toning system whether that recorder is a xerographic printer or a zinc-oxide printer. This powdered, electrostatically sensitive toner has a tendency to find its way into undesired areas thus creating a problem of cleanliness for the toner system.

One area which the toner continuously tends to contaminate is the back of the paper upon which a facsimile is to be made. This contamination is caused because the toner must be uniformly spread over the entire surface of the paper in order to be attracted to those areas which have been charged. The toner that is not attracted to the discharged areas of the paper is returned to the toner system. However, the toner has a tendency to creep under the paper and thus is not able to return to the toner system under the urging of the magnetic toner brush. Once the stray toner has been passed through the fuser and heated, the toner is permanently affixed to the paper sheet in areas where it is not desired, especially the back edges.

Another problem with toner systems is that the toner has a tendency to gather in undesired masses under the urging of the magnetic toner brush. This accumulation of the toner causes other areas to be short of desirable amounts of toner which creates a void in the toner as it is spread across the paper upon which a copy is to be made. Thus, a desirable toner system must supply void-free toner which is uniformly spread across the paper.

Within each electrophotographic recording system, the amount of exposure of the charged paper to toner is also a critical factor. The above-mentioned copending patent application by Rodger discusses an inventive concept wherein the length of the paper path exposed to the toner is controlled. This invention may be used in combination with Rodger's invention to prevent the spread of unwanted toner, while enchancing its void-free application to the surface of a sheet of paper.

Accordingly, it is an object of the present invention to provide an improved toning system which prevents the toner from creeping under the back of a page upon which a copy is to be made. It is another object of the present invention to provide an improved toner system which controls the flow of the toner and prevents it from accumulating in undesired areas or creating voids in other areas.

In accomplishing these objects, there has been provided a toner reservoir having an opening therein which is partially closed by a cylindrical toner brush. Rotation of the magnetic cylinder within the brush causes the toner to flow about the surface thereof in a circular path for presentation to an opening within the toner container. A paper roller presents the paper to the toner brush and toner at this opening.

The toner opening has a trapezoidal shape with equal legs so that a narrow base first contacts the flowing toner. The wide base of the trapezoidal opening is wider than the paper to permit the toner to diverge as it flows across the paper. In this manner, the flow of the toner has been preestablished in a diverging direction. As the toner reaches the edge of the paper, it tends to retain its direction of flow thus preventing it from creeping back under the edge of the paper. The toner which adheres to the charged areas is then fused by heat while the toner that was not exposed to a charge area is returned to the container under the urging of the magnetic toner brush.

The toner brush includes a fixed nonmagnetic cylindrical shell which covers a rotating magnetic cylinder. This shell frictionally engages a wiping blade attached in the lower portion of the toner container having apertures disposed therein. As the toner somersaults about the cylindrical shell under the urging of the rotating magnetics, the toner passes through the apertures within the blade and continues in its circular path about the brush. After each copy, the cylindrical shell is intermittently rotated so that the blade scrapes excess toner from the shell to prevent unwanted accumulation of toner.

As the toner continues around the toner brush, it passes through a constricting area formed by the sidewalls of the toner container which forces the overall width of the toner flow to a narrow pattern that matches the narrow base of the toner opening. Disposed above this constricting area is a control plate which forms a fixed spacing between the cylindrical shell for removing an excess depth of toner that the constriction might creat.

DESCRIPTION OF THE PREFERRED EMBODIMENT

Figure 1:
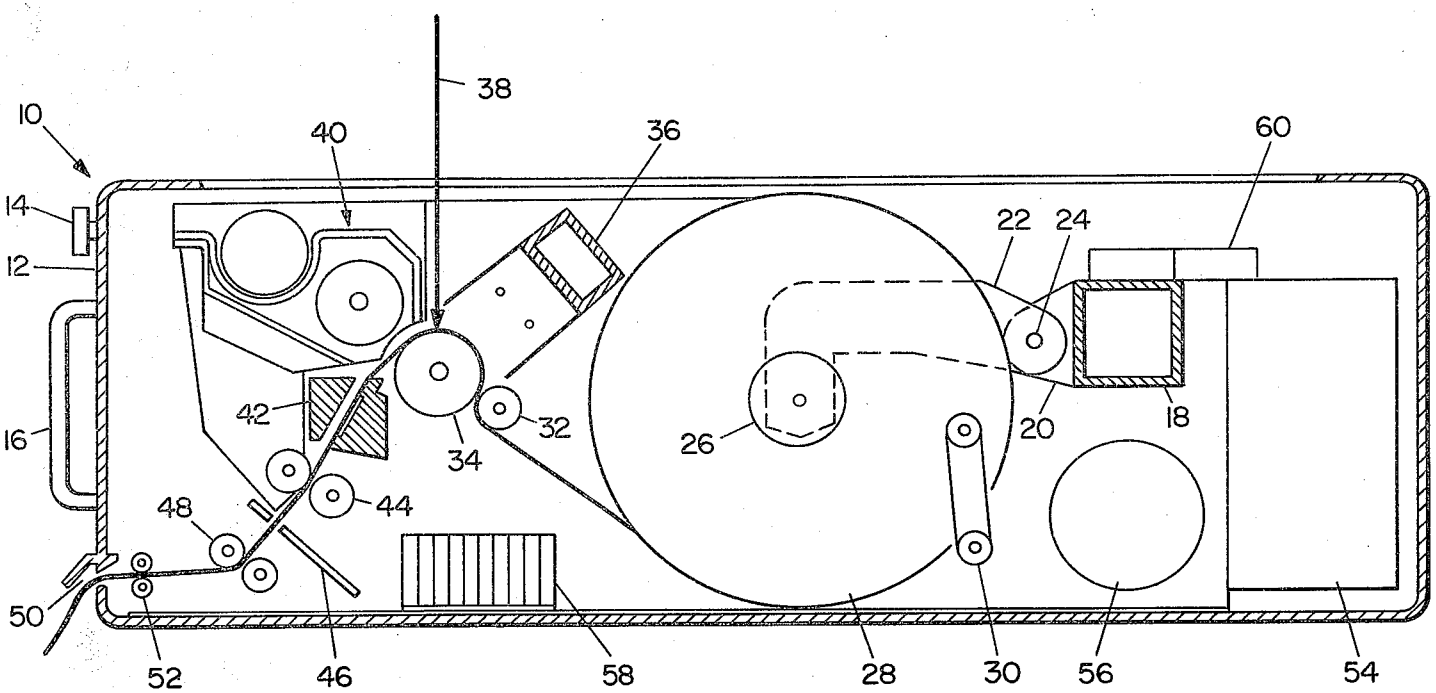
FIG. 1 is a cross-sectional view showing an electrophotographic recorder incorporating the improved toning system of the present invention.

Referring now to FIG. 1, an electrophotographic recorder 10 is shown mounted within a housing 12 which, in turn, may be mounted within a rack of electronic equipment, not shown. The housing 12 is provided with latches 14 and handles 16 to facilitate rack mounting upon slides, not shown. Removal of the housing 12 from the rack upon its slides will expose the upper surface of the housing which may be open, when mounted within a rack, or closed by a cover, when used upon a bench.

Mounted within the housing 12 is a box-beam frame 18 having support tabs 20 extending therefrom which form a pivot point for a mounting frame 22 attached to the tabs 20 by pins 24. The frame 22 mounts a paper supply roller 26 about which is wound a quantity of paper 28 which, in the preferred embodiment, is a roll 8½ inches wide by 400 feet long. As the paper 28 is spooled from the roller 26, the level of paper upon the roll is sensed by a paper level sensor 30, such as a following roller attached to a lever arm which actuates a cam switch when the lever arm reaches a predetermined position indicating that a short length of paper remains upon the roller.

As the paper 28 is spooled from the roller 26, it passes over a first guide roller 32 and wraps about a paper roller 34. The paper roller 34 has a larger diameter than the guide rollers to enable the paper 28 to be electrostatically charged by a charger 36, such as a corona electrostatic charger which imparts an electrical charge, generally in the dark, to a photoconductive material, such as a zinc-oxide coating upon the paper 28. As the paper 28 departs the corona charger 36 it is struck by electromagnetic energy, illustrated by a beam 38. The electromagnetic energy may be infrared, visual radiation or ultraviolet radiation. In the preferred embodiment, the radiation comes from the coherent light beam of a laser.

After the paper has been charged by the corona charger 36 and discharged by the light beam 38, it is exposed to a toner assembly 40 where toner is applied over a fixed path length $\theta$ of the paper 28, as will be described in FIG. 2 below. The toner which has adhered to the remaining charged surfaces of the paper 28 next passes through a fuser 42 which heats the paper and toner to fuse the toner permanently to the paper. In the preferred embodiment, the toner is formed as powdered dry ink which, when exposed to heat, adheres to the paper.

The paper 28 is then pulled from the fuser 42 by pinch rollers 44 and driven past a shear 46 by a second pair of pinch rollers 48. The paper then exits through an exit aperture 50 under the drive of a last pair of pinch rollers 52.

The housing 12 has been provided with adequate room for a power supply 54, shear and pinch roller motor 56, and electronics 58. Also provided are rack and panel connectors 60 which supply power to the power supply 54 and necessary input telemetry to the electronics 58. As the zinc-oxide-coated paper 28 must be exposed to electromagnetic energy from an external source in the embodiment shown, the upper surface of the housing 12 is open to permit the passage of the electromagnetic energy, beam 38, or provided with a slot when a cover is utilized.

Figure 2:
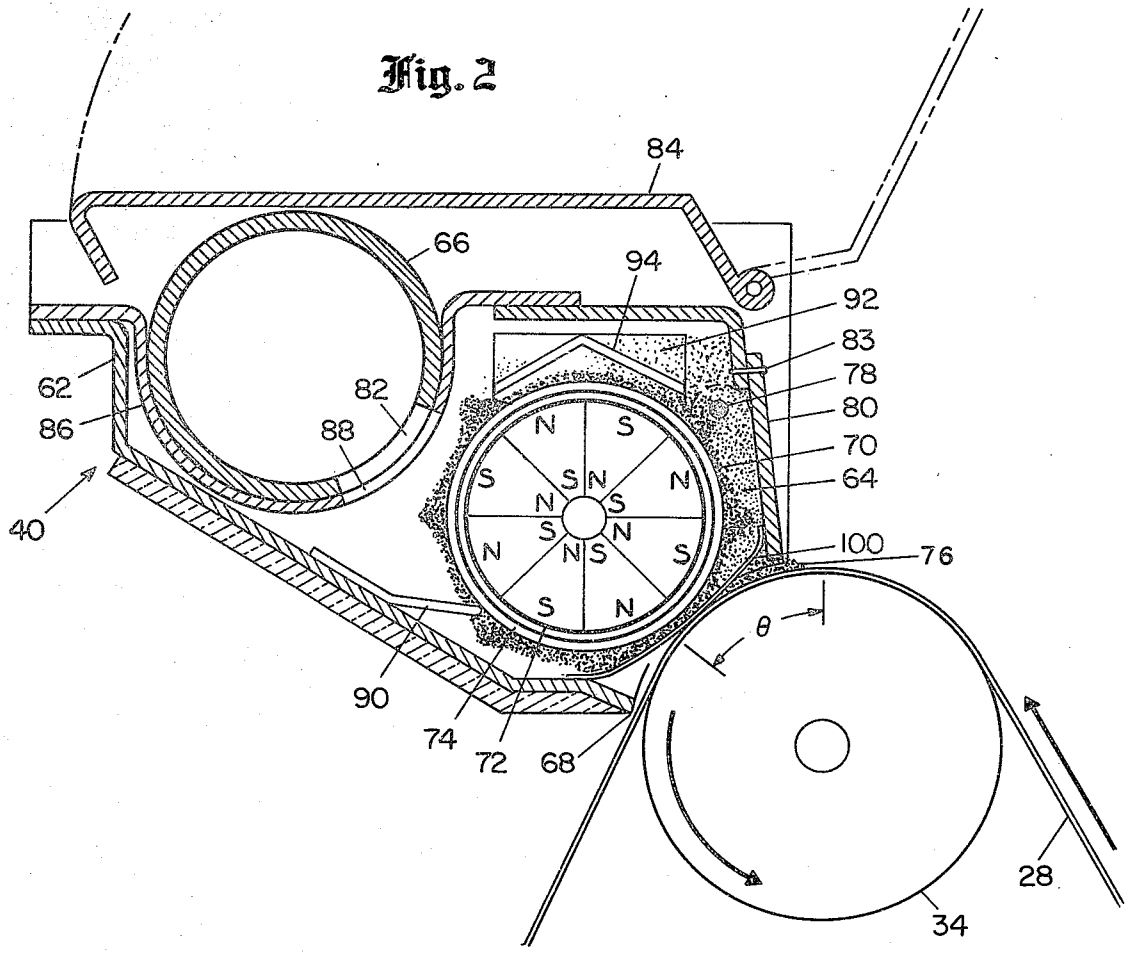
FIG. 2 is a cross-sectional view showing the improved toner system.

Referring now to FIG. 2, the details of the toner mechanism assembly 40 are shown wherein the paper 28 passes over the top of the paper roller 34 and under the toner assembly 40. The toner assembly 40 consists of a container 62 that may be formed from molded plastic, cast aluminum, or sheet metal to creat a reservoir for a powdered toner 64. In the preferred embodiment, the toner container 62 is a long, narrow container having a polygonal cross-section whose lower surface slopes in an upward direction, as one moves away from the paper roller, toward a toner cartridge 66 which supplies the toner 64 to the container 62. The lowermost corner of the container 62 is provided with an opening 68 which is closed, at least partially, by a toner brush assembly 70. The opening 68 extends longitudinally along the full periphery of the paper roller 34 so that the combination of the toner brush assembly 70 and paper roller 34 substantially close the toner container opening 68. The paper thus passes between the roller 34 and the toner brush assembly 70 due to the counterclockwise rotation of the paper roller 34 driven by motor 56.

The toner brush assembly 70 includes a cylindrical magnetic roller 72 which may be formed from a plurality of permanent magnets having north to south poles running longitudinally along the axis of the magnetic roller 72. Alternately, the magnetic roller 72 may be formed from permanent magnet material that has been magnetized to form longitudinal poles along the surface thereof parallel to its axis of rotation. The magnetic roller 72 also rotates in a counterclockwise direction driven by motor 56.

A thin sleeve of nonmagnetic material 74 covers the magnetic roller 72 which is capable of rotation but is normally fixed so that the sleeve does not rotate on a continuous basis. The sleeve 74, which may be constructed from a thin aluminum tube, is placed as close to the magnetic poles formed within the magnetic roller 72 as practical since penetration of the magnetic field into the toner container 62 is desired. As the magnetic roller 72 rotates in a counterclockwise direction, the magnetic field established by the rotating magnetic poles causes the toner 64, which is a magnetic powdered ink, to move in response to the magnetic field. The toner movement is a flipping movement in a direction opposite the direction of rotation of the magnetic roller. Thus, the motion of the toner in a clockwise direction, in combination with the rotation of rollers 34, creates the effect of pinching the toner into the space formed between the rotating paper roller 34 and the fixed toner sleeve 74.

This pinching effect causes the excess toner to pile up behind the space between roller 34 and sleeve 74. As the toner 64 builds up, it trys to spill out of the opening 68 and on to the surface of the paper 28 which is being fed into that opening by the rotational motion of the paper roller 34. The combination of the magnetic attraction between the toner particles and the paper motion causes a convex toner meniscus 76 to form upon the paper. This meniscus soon establishes an equilibrium point as the excess toner pinched between the toner brush assembly 70 and paper roller 34 begins to pile up, not in the meniscus, but within the toner reservoir formed by container 62. As the amount of toner is depleted within the meniscus 76, the toner level in the reservoir drops to replenish the meniscus. A toner level sensor 78, such as a light-sensitive diode and light emitting source, may be provided in the reservoir to indicate when the toner level drops below a desired reserve.

In the preferred embodiment, the magnetic roller rotates seven times faster than the paper roller.

An adjustment of the convex meniscus 76 may be accomplished by adjusting the level of a toner gate 80 formed at the right-hand vertical surface of the toner container 62. The toner gate may be adjusted up and down by adjusting screws 83 to vary the size of the meniscus 76. In the preferred embodiment, a space of approximately 1/32 of an inch between the gate 80 and paper roller 34 has been found satisfactory. By adjusting the rotational ratio between the magnetic toner brush assembly 70 and the paper roller 34 and by adjusting the space of the opening 68 between the top of roller 34 and the bottom of toner gate 80, one may adjust the size of the meniscus 76. The size of meniscus 76 establishes the paper path length $\theta$ that is exposed to the toner 64.

In the preferred embodiment, the toner 64 is placed within the cylindrical toner cartridge 66 which is formed with a longitudinal, peripheral aperture 82 at least as long as the width of the paper 28. To load the toner container 62, a container cover 84 is opened and the toner cartridge 66 placed into an appropriate semicircular receptacle 86. The semicircular receptacle 84 is provided with a longitudinal aperture 88 which extends along its lower, inner surface adjacent the toner brush assembly 70. The toner cartridge aperture 82 is closed by a suitable closure, such as a flexible plastic sheet adhered to the container 66 or a second cylindrical tube having a second aperture. Removal of the adhesive sheet or rotation of the second cylinder exposes the aperture 82. The toner cartridge 66 is then placed in the receptacle 84 and rotated until apertures 82 and 88 are aligned causes the toner 64 to spill through the apertures into the toner container reservoir 62. The arrangement of the toner cartridge 66, toner container 62 and the semicircular toner receptacle 84 prevents toner from spilling or accidentally flying into unwanted areas.

As the toner 64 spills down the slope of container 62, it contacts a blade 90. The blade 90 is attached by spot welding or other suitable fasting means to container 62 and is provided with an anglularly extending surface which frictionally engages the surface of the nonmagnetic cylindrical sleeve 74. Disposed within the extending surface of blade 90 are a plurality of apertures through which the tumbling powdered toner may pass under the urging of the rotating magnetic roller 72. The sleeve 74 is periodically rotated in a clockwise direction by power supply from the motor 56 under the control of electronics 58. The rotation of the shell 74 is intermittent and, in the preferred embodiment, occurs after each copy is made. Thus, blade 90 cleans the surface of the toner brush assembly 70 after each copy which prevents the accumulation of unwanted toner particles.

As the toner particles continue to tumble in a clockwise direction about the nonmagnetic sleeve 74, they approach an area along the top of the toner brush assembly 70 in which the sidewalls of the container 62 are constricted to laterally compress the flow of the toner. This constriction is accomplished by reducing the width of the sidewalls of the container, which could be a casting in which the constrictions have been molded. The constrictions may also be formed from sheet metal pieces 92 when a sheet metal container is utilized. Located in the area above the constrictions 92, is a control plate 94 which establishes a fixed space between the outer surface of the sleeve 74 and the leading edge of plate 94. Any excess toner piled upon the sleeve 74 is removed from its accumulated mass by the leading edge of plate 94 and accumulated behind the plate in a reservoir area which, as the toner level decreases, permits the toner to again fall against the sleeve 74 and flow toward the opening 68 within the toner container. The constrictions 92 and plate 94 are shown schematically in FIG. 3.

As the toner continues to flow in a clockwise direction beyond the control plate 94, it passes into the reservoir area formed behind the toner gate 80. The meniscus 76 established by the flowing toner 64 and the moving paper 28 prevents the exit of excess toner which piles up behind the toner gate 80. The second angled blade of the control plate 94 acts as a second reservoir to prevent the excess toner building up behind the toner gate from passing back toward the first reservoir. Again, this reservoir empties as the toner level drops for assuring a steady supply of toner to the meniscus 76.

As the toner passes behind the toner gate 80 and is exposed to the opening 68, it spills from the opening upon the paper 28 in the form of the meniscus 76. In the preferred embodiment, the opening 68 has a trapezoidal configuration with equal side legs so that the upper and lower angles of the opening are equal with the narrower base of the trapezoid 96 first contacting the flowing toner 64, FIG. 4. The width of the narrower base is established at a width which is less than the width of the paper 28. As the toner flows into the meniscus 76 and then along the paper 28 under the urging of the toner brush assembly 70, it is guided into a diverging path due to the angled sides of the opening 68. The trapezoidal opening has a wider base 98 whose width is greater than the width of the paper 28. The configuration of the trapezoidal opening permits the toner 64 to flow from the narrow area of the meniscus 76 to a wider area in a diverging manner. This diverging flow establishes a direction for the toner which continues once the toner reaches the edge of the paper 28. The toner flow, thus established, does not reverse after the toner has passed beyond the edge of the paper. Excess toner which has not been attached to the charged areas upon the surface of the paper 28 is then attracted back to the surface of the cylindrical shell 74 by the urging of the magnetic roller 72. This prevents the toner from creeping under the edge of paper 28 as it wraps about roller 34 and exits the toner assembly 40.

Figure 4:
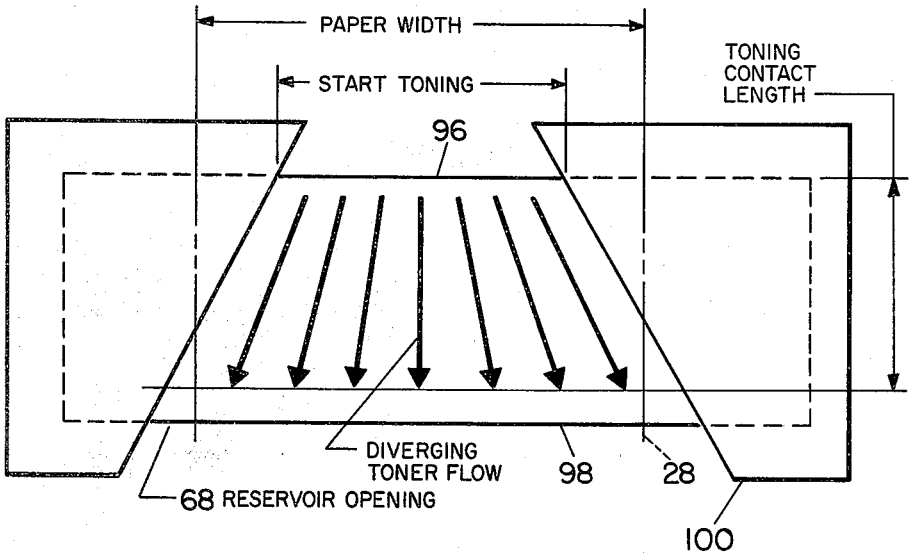
FIG. 4 is a schematic drawing illustrating the trapezoidal opening of the toner container.

The embodiment thus described is shown in detail in FIG. 4 wherein the trapezoidal opening 68 is shown in solid lines. In the preferred embodiment, shown in FIG. 2, the equal sides of the trapezoidal opening 68 are formed by two flexible sheets of polypropylene material 100. The two sheets 100 are generally triangular in shape and close an otherwise rectangular opening 68. The advantage of these flexible sheets is that they adhere to the surface of the paper and form a tight contact therewith while remaining flexible enough to accommodate different sizes of paper. Clearly the opening 68 may be shaped as a trapezoidal opening thus eliminating the need for the flexible sheets 100.

Figure 3:
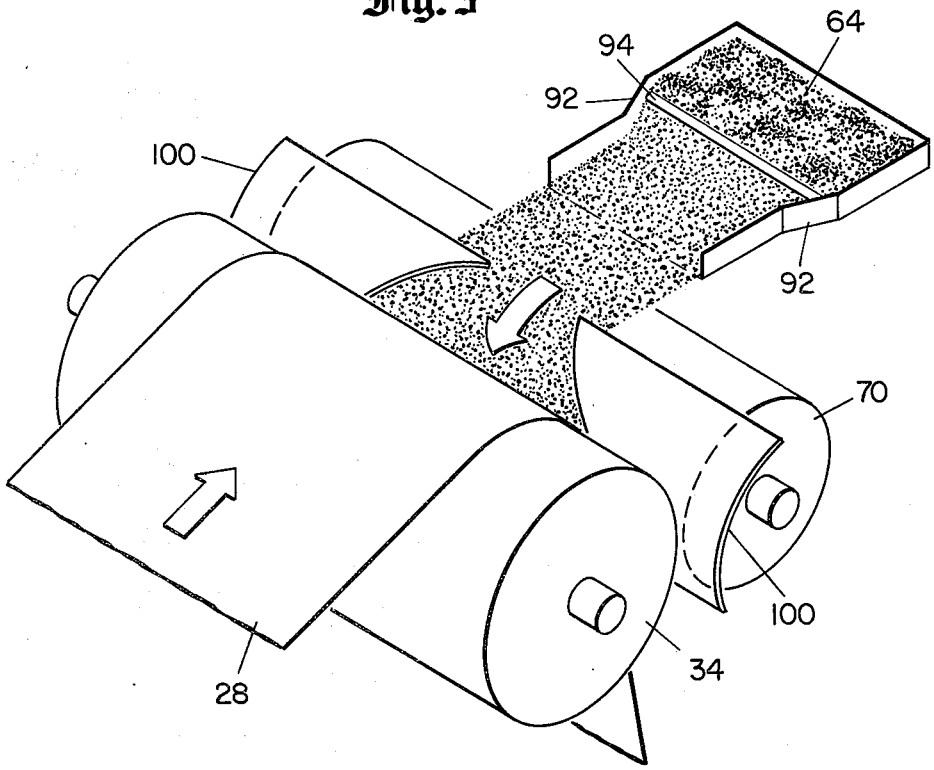
FIG. 3 is a schematic diagram illustrating the features of the improved toning system.

It will be seen from a review of FIGS. 2 and 3, that the toner 64 moves about the sleeve 74 in a clockwise direction. After the toner has been placed into the container 62 from cartridge 66, it slides down the inclined surface of container 62 where it is restrained from passing beyond the toner brush assembly by the blade 90.

The toner is attracted to the shell 74 by rotation of the magnetic wheel 72 and place in motion in a clockwise direction even though the roller is rotating in a counterclockwise direction.

As the toner passes between the constrictive plates 92, the flowing width of its mass is constricted. Any excess toner which might pile up due to the constriction or an excessive amount of toner within the containers 62 will be removed by a control plate 94 and stored in the reservoir formed above that plate. The toner continues next falling into the reservoir behind the toner gate 80 before it flows between the toner brush assembly 70 and the roller 34. The toner may pass out into the meniscus 76 or it may back up behind the meniscus into the second reservoir formed between the gate 80 and the roller assembly 70. As the toner backs up in this reservoir, it is prevented from flowing backward the area of the cartridge 66 by the second blade of the control plate 94 which forms a third reservoir above that plate.

After the toner has passed over the surface of the paper 28, the toner which has not adhered to the paper due to the charged areas upon that paper passes back into the container 62. The toner then contacts blade 90 and tumbles through the aperture within that blade back into the main reservoir of container 62. After each copy is made, the cylindrical sleeve 74 is rotated a short distance causing the blade 94 to scrape excess toner from the sleeve surface which then tumbles through the apertures back into the main reservoir.

The arrangement thus described prevents toner from passing under the paper 28 as that paper passes through the improved toning system. Further, the system controls the toner to prevent an excess accumulation or, conversely, to prevent voids from forming therein. Container opening 68 has been described as either a trapezoidal opening or a rectangular opening having two triangular, flexible elements which form a trapezoidal configuration. The various elements located about the toner brush assembly may be utilized or disposed of depending on the amount of control over the toner desired. Clearly, other modifications and variations of the present invention will become apparent to those skilled in the art; thus, the present invention should be limited only by the appended claims:

I claim:

1. An improved toner system for use in an electrophotographic recorder for toning the charged areas upon a sheet, comprising:

container means for said toner having an opening therein, toner brush means mounted within said container means for moving said toner and partially closing said opening, roller means for transporting said sheet adjacent said toner brush means where said moving toner contacts said sheet and adheres to said charged areas thereon, and toner guide means mounted within said opening for masking said sheet as said moving toner contacts said sheet and guiding said moving toner into a diverging flow as said toner contact continues.

2. An improved toner system, as claimed in claim 1, additionally comprising:

said toner brush means having a cylindrical shape whose longitudinal axis is longer than the width of said sheet, said container means surrounding said toner brush means, constricting means mounted in said container means adjacent said cylindrical brush means for urging said toner into a path width narrower than the width of said sheet prior to said opening.

3. An improved toner system, as claimed in claim 1, additionally comprising:

said toner brush means having a cylindrical shape, said container means surrounding said toner brush means, blade means mounted in said container means for contacting said cylindrical toner brush means having apertures therein through which said toner may pass for mixing said toner and removing said toner from the surface of said cylindrical toner brush means.

4. An improved toner system, as claimed in claim 3, additionally comprising:

said cylindrical toner brush means including a cylindrical shell of nonmagnetic material and a magnetic cylindrical roller rotatably mounted therein, means for rotating said cylindrical shell, and said blade means frictionally contacting said cylindrical shell for removing said toner therefrom as said shell is rotated.

5. An improved toner system, as claimed in claim 4, wherein said rotating cylindrical shell is rotated intermittently.

6. An improved toner system, as claimed in claim 1, wherein said toner guide means is a trapezoidal opening of said container means having equal sides with a narrow base which first receives said moving toner that first contacts said sheet and a wide base, said sheet being wider than said narrow base and narrower than said wide base.

7. An improved toner system, as claimed in claim 1, wherein said toner guide means are flexible triangular masks mounted between said toner brush means and said roller means on each side of said container opening to restrict the width of said opening as said toner passes into contact with said sheet while permitting the divergence of said toner as said toner continues its contact with said sheet.

8. An improved toner system, as claimed in claim 1, additionally comprising:

said toner brush means having a cylindrical shape, said container means surrounding said toner brush means, control means mounted in said container means adjacent to and spaced from said cylindrical brush means for controlling the moving flow of said toner by limiting the space between said cylindrical toner brush means and said control means and creating a reservoir within said container means.

9. An improved toner system for placing a powdered toner upon the surface of a paper having charged areas thereon, comprising:

a toner reservoir having an opening;

a toner brush assembly for moving said toner in a circular path within said reservoir, passed said reservoir opening and against said paper;

said reservoir opening having a trapezoidal configuration with a narrow and wide base and equal sides, said narrow base first receiveing said moving toner; said narrow base narrower than said paper and said wide base wider than said paper.

10. An improved toner system, as claimed in claim 9, additionally comprising:

said trapezoidal reservoir opening formed by masks mounted within said reservoir for closing the ends of said reservoir opening.

11. An improved toner system, as claimed in claim 10, wherein said masks are formed from two flexible, triangle-like sheets.

12. An improved toner system, as claimed in claim 9, additionally comprising:

said toner reservoir having constricting sides beyond said wide base of said reservoir opening for urging said moving toner into a narrow path prior to receipt by said narrow base of said reservoir opening as said toner moves in said circular path.

13. An improved toner system, as claimed in claim 12, additionally comprising:

said toner reservoir having a control member spaced from said toner brush assembly between said constricting sides for controlling said moving toner by limiting the amount of toner that may be moved between said constricting sides.

14. An improved toner system, as claimed in claim 9, additionally comprising:

said toner brush assembly including a rotatable magnetic roller and a surrounding nonmagnetic cylindrical shell, a blade mounted within said reservoir for frictionally contacting said shell having apertures therein to permit the movement of said toner about said circular path, and means for intermittently rotating said shell to remove toner from the cylindrical surface thereof.

* * * * *